US007144282B1

(12) United States Patent
Shen et al.

(10) Patent No.: US 7,144,282 B1
(45) Date of Patent: Dec. 5, 2006

(54) CONTOURED RUDDER MANEUVERING OF WATERJET PROPELLED SEA CRAFT

(75) Inventors: Young T. Shen, Potomac, MD (US); Edward S. Ammeen, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/126,511

(22) Filed: May 9, 2005

(51) Int. Cl.
*B63H 11/117* (2006.01)

(52) U.S. Cl. ..... 440/43; 114/163

(58) Field of Classification Search ..... 441/43; 114/162; 440/41, 43
See application file for complete search history.

(56) References Cited

U.S. PATENT DOCUMENTS 4,421,489 A * 12/1983 Van Veldhuizen ..... 440/37
4,895,093 A * 1/1990 Dalsbo ..... 114/163
5,505,640 A * 4/1996 Angulo ..... 440/43
6,976,445 B1 * 12/2005 Arneson ..... 114/315

* cited by examiner

*Primary Examiner*—Stephen Avila
(74) *Attorney, Agent, or Firm*—Jacob Shuster

(57) ABSTRACT

The stern hull portion of a surface ship or underwater sea craft is provided with a waterjet propulsion unit having an outlet end from which a discharge propelling waterjet emerges underwater and undergoes flow beyond the stern end of the hull between a pair of twin contoured rudders normally positioned for straight forward propulsion of the hull. The contoured rudders pivotally mounted underwater on the hull are angularly displaced by maneuvering control in opposite directions from the normal positions to maneuvering positions with their lower end tips in contact with each other to form a bucket to directionally change flow of the emerging waterjet for steering, deceleration and backing purposes during hull propulsion between low and high speeds. The twin rudders are also angularly displaced by the maneuvering control in the same angular direction for a different directionally regulated change in waterjet flow to effect turning of the hull for propulsion in a reverse direction.

4 Claims, 2 Drawing Sheets

CONTOURED RUDDER MANEUVERING OF WATERJET PROPELLED SEA CRAFT

The present invention relates generally to waterjet propulsion and maneuvering of a sea craft.

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

Currently ships or sea vessels that are commercially utilized in the marine industry and U.S. Navy are propelled by waterjets discharged into the air above the seawater surface. Such air discharged jets undergo plumbing into the water to create undesirable impact noise and generate bubble spray or clouds which hinder visibility and splash water onto neighboring sea craft and docking piers being approached. Furthermore maneuvering of waterjet propelled sea craft routinely involve use of rotating steering sleeves or buckets for steering/backing vectored deflection of the propulsion jets within air so as to avoid severe drag and broadband noise experienced with underwater propulsion jets. Moreover, the bulkiness of the aforementioned rotating sleeves trigger severe undesirable cavitation. It is therefore an important object of the present invention to provide for waterjet propulsion and maneuvering of both surface and submerged sea craft by waterjet discharge underwater without the problems and disadvantages associated therewith and the bulkiness of associated operational equipment heretofore experienced with air discharging water jet propulsors.

SUMMARY OF THE INVENTION

Pursuant to the present invention, a surface or submerged sea craft is propelled by a waterjet unit positioned on the sea craft hull for underwater discharge of a water propulsion jet between a pair of contoured rudders that are pivotally mounted on the hull for angular displacement from parallel spaced positions accommodating straight forward and cavitation-free propulsion of the sea craft by emergence of the waterjet between the rudders. Displacement of the rudders to positions in contact with each other at their lower tips to form a closed bucket, or to low and high speed turn imposing positions extending angularly in the same direction from the hull centerline is effected for steering and backing of the sea craft under maneuvering control.

BRIEF DESCRIPTION OF THE DRAWINGS

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENTS

Figure 1:
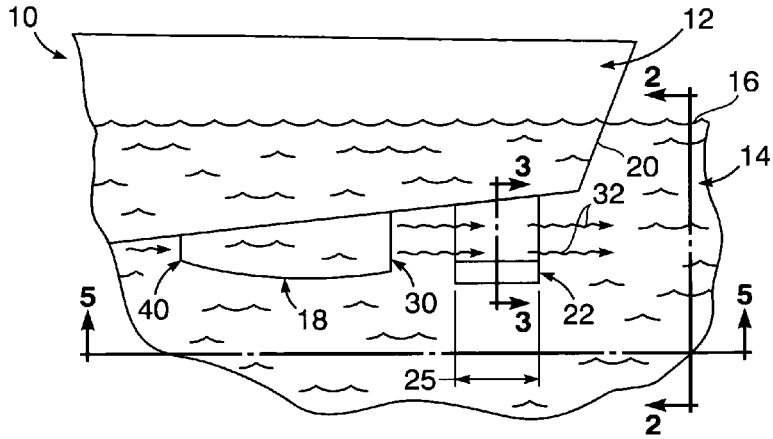
FIG. 1 is a side elevation view of the stern end portion of a surface sea vessel underway in seawater, with a waterjet propulsion unit and maneuvering rudders positioned thereon underwater.
Figure 2:
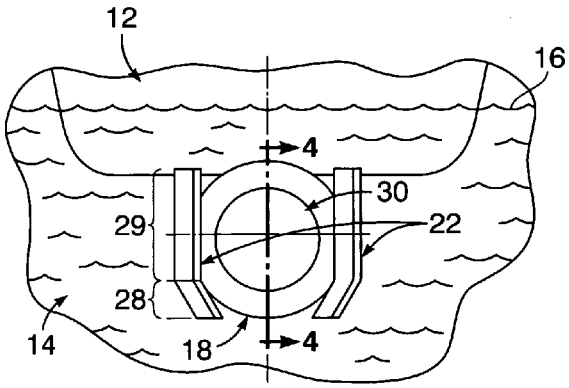
FIG. 2 is a partial front elevation view of the stern end portion of the sea vessel shown in FIG. 1, as viewed from section line 2—2.
Figure 4:
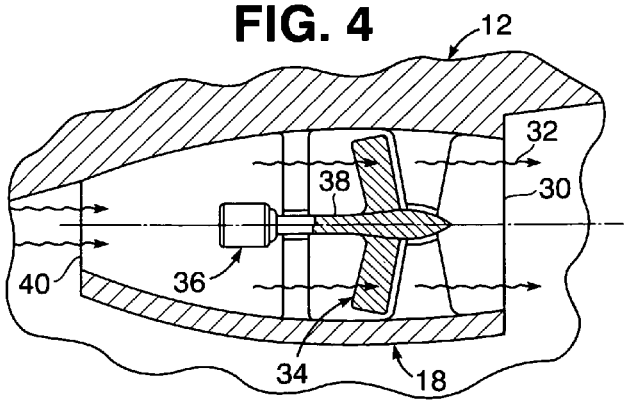
FIG. 4 is a partial section view taken substantially through a plane indicated by section line 4—4 in FIG. 2.

Referring now to the drawing in detail, FIGS. 1, 2 and 4 illustrate a surface sea vessel 10 having a hull 12 immersed in seawater 14 and extending vertically above the water surface 16 during normal forward travel. A waterjet propulsion unit 18 is positioned underwater on a bottom portion of the hull 12 closely spaced from its stern end 20. A pair of twin contoured rudders 22 are also locationally positioned on the bottom of the hull 12 between the stern end 20 and the waterjet propulsion unit 18.

Figure 3:
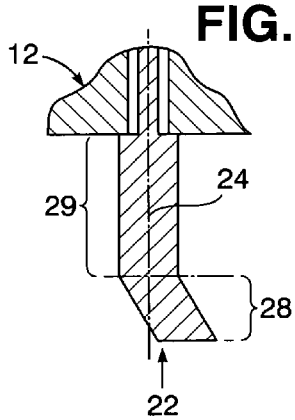
FIG. 3 is a partial section view taken substantially through a plane indicated by section line 3—3 in FIG. 1.
Figure 5:
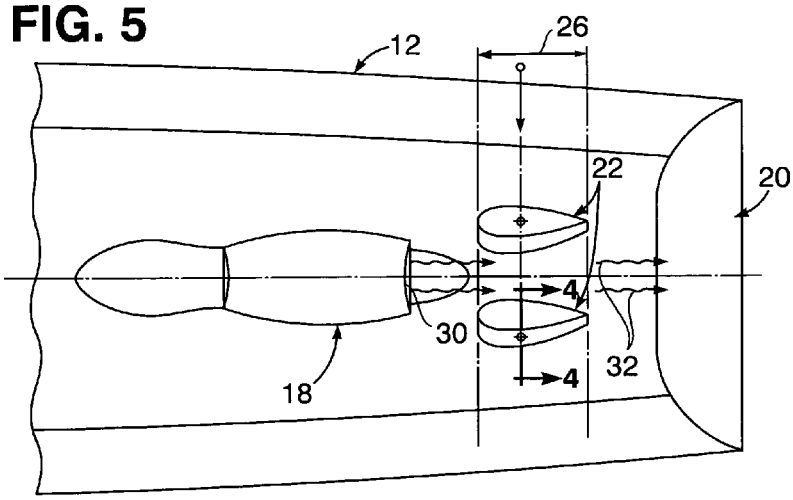
FIG. 5 is a bottom plan view of the sea vessel shown in FIG. 1, as viewed from section line 5—5.

As shown in FIGS. 2, 3 and 5, each of the rudders 22 respectively extends vertically downward in spaced adjacency to the stern end 20 from the bottom of the hull 12 for angular adjustment about parallel spaced axes 24, as denoted in FIG. 3, under maneuvering control as hereinafter explained. Each of the rudders 22 as shown in FIGS. 1 and 5 has a horizontal dimension 26 of 9.4 feet for example. Lower portions 28 of the rudders 22 extend toward each other at an acute angle from their longer top vertical portions 29 as shown in FIGS. 2 and 3. The rudders 22 are so configured on opposite lateral sides of an underwater positioned exit jet nozzle 30 of the propulsion unit 18. Accordingly, propulsion jets 32 emerging from the exit nozzle 30 pass between the rudders 22 as shown in FIG. 5.

Referring now to FIG. 4, outflow of the emerging propulsion jets 32 from the exit nozzle 30 of the propulsion unit 18 is induced by rotation of an impeller 34 by a motor 36 connected to the impeller 34 by an impeller pump shaft 38. Primary propulsion of the sea vessel 10 is thereby effected in response to inflow of seawater into an inlet end 40 of the propulsion unit 18 induced by rotation of the impeller 34. Typically the exit speed of the propulsion jets 32 is about 60% higher than the speed of the sea vessel 10 when the rudders 22 are in straight ahead positions aligned with the outflow exit jets 32 as shown in FIG. 5.

Figure 5A:
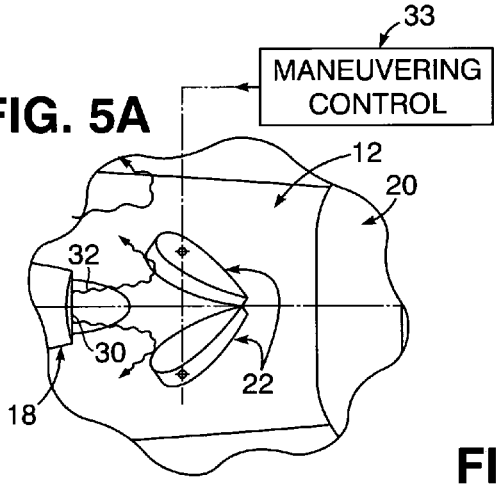
FIGS. 5A and 5B are partial bottom plan views corresponding to that of FIG. 5, respectively showing the rudders in a closed bucket maneuvering position and in one of two u-turn maneuvering positions.

The rudders 22 under maneuvering control 33 diagrammed in FIG. 5A are angularly displaced about their axes 24 into closure contact with each other at their lower tips so as to form a bucket as shown in FIG. 5A. The main portion of the jet stream is thereby diverted to the lateral sides in a reversed forward flow direction toward the bow end of the hull 12 to impose negative thrust. The remaining smaller portions of the jet stream move upwardly along the top portions 29 of the rudders 22 and are then diverted forwardly toward the bow end of the hull 12 for also producing negative thrust. The total negative thrust produced by the rudders 22 in their bucket closure positions shown in FIG. 5A is substantially larger (such as 4.79 times greater) than the forward propulsion thrust produced during normal forward propelling operation for emergency stopping, deceleration or backing purposes.

Figure 5B:
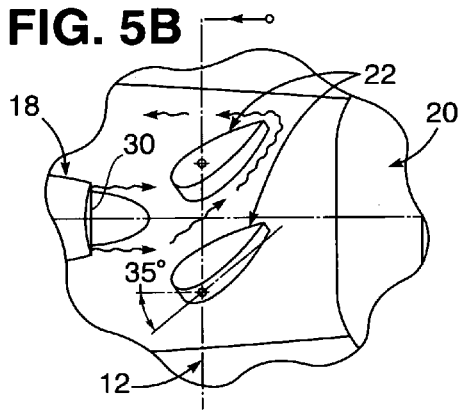

A tight turn of the sea vessel 10 is effected by the maneuvering control 33 imparting angular displacement to the rudders 22 by 35° in the same direction to positions with the leading edge of only one of the two rudders 22 in the jet stream as shown in FIG. 5B. Due to the high jet stream velocity, the side turning force thereby imposed on the hull 12 is greatly increased by a significant amount. Such increased side turning capacity of the rudders 22 is accordingly effective to turn the sea vessel 10 even during forward propulsion at low speeds. Furthermore during the straight-and-level course operation of the rudders 22, as shown in FIG. 5, reduced drag and less broadband noise is imposed.

Figure 6:
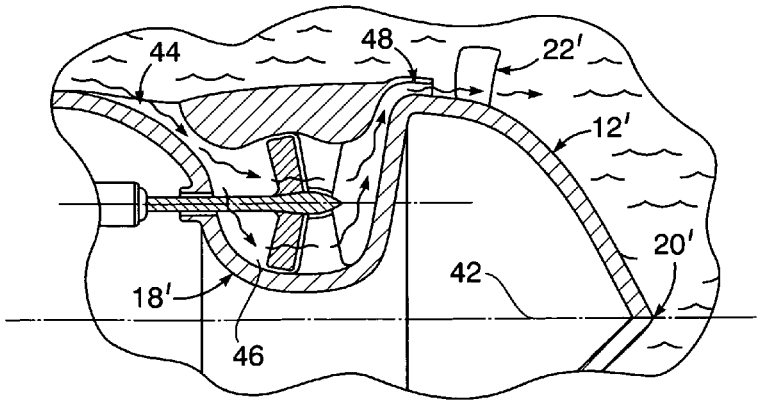
FIG. 6 is a partial side section view through a fully submerged underwater sea craft, with an arrangement of waterjet propulsion and maneuvering rudder facilities corresponding to those shown in FIGS. 1–5.

The maneuvering concepts associated with the rudders 22 as hereinbefore described, are also applicable to a fully submerged underwater sea vessel hull 12' as shown in FIG. 6, having a stern end 20' on its centerline 42. A waterjet propulsion pump unit 18' associated with the hull 12' is located in forwardly spaced relation to a pair of twin rudders 22' positioned along the centerline 42. The rudders 22' are contoured similarly to the rudders 22 as hereinbefore described. A curved water inflow inlet 44 on the outer peripheral surface of the hull 12', directs inflow of water into an annular enclosure 46 within the propulsion unit 18' from which a curved outflow exit nozzle 48 extends. Accordingly, the outflowing water propulsion jets emerging from the exit nozzle 48 pass between the rudders 22', contoured and subject to maneuvering angular displacement as hereinbefore described with respect to the rudders 22.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a sea vessel hull having a centerline and a stern end, a pair of contoured rudders positioned underwater on the hull in spaced relation to each other and configured to provide directional stability and low drag to the sea vessel in addition to maneuvering performance for steering and stopping the sea vessel; waterjet propulsion means mounted on the hull for underwater discharge of a propelling waterjet toward the stern end of the hull; and maneuvering means for displacement of the contoured rudders from a normal position in spaced relation to each other between which the discharged waterjet forwardly propels the hull straight ahead;

wherein the contoured rudders are displaced by the maneuvering means from the normal position to one or more maneuvering positions directionally changing propulsion flow of the discharged waterjet to effect steering, deceleration, stoppage, backing and directional turning of the hull during low to high speed seawater travel induced by the propulsion by the underwater waterjet;

wherein each contoured rudder is positioned on the hull such that the rudder is outside of the propelling waterjet when the rudder is in the normal position and a portion of the rudder is configured to extend into the propelling waterjet when the rudder is in at least one of the maneuvering positions; and wherein each contoured rudder has a straight ton portion pivotally mounted underwater on the hull and a straight lower portion connected to the top portion, the lower portion extending at an acute angle from the to portion and terminating at a lower tip, wherein the top portions of the rudders are parallel to each other and the lower portions of the rudders extend in a direction towards each other when the rudders are in the normal position, and wherein at least the top portions of the rudders have an airfoil shape.

2. The combination as defined in claim 1, wherein in one of the maneuvering positions the contoured rudders contact each other form a bucket directionally changing said flow of the discharged waterjet to produce a negative thrust on the hull under conditions of said steering, deceleration and backing; and in two other turning positions of the contoured rudders said flow of the discharged waterjet is directionally reversed respectively in opposite angular directions relative to the centerline of the hull.

3. The combination as defined in claim 2, wherein the sea vessel is a surface ship.

4. The combination as defined in claim 2, wherein the sea vessel is an underwater sea craft.

* * * * *